US008567380B2

(12) United States Patent
Nugent

(10) Patent No.: US 8,567,380 B2
(45) Date of Patent: Oct. 29, 2013

(54) AIR GUN APPARATUS

(75) Inventor: David Michael Nugent, Newport, RI (US)

(73) Assignee: Hasbro, Inc., Pawtucket, RI (US)

( * ) Notice: Subject to any disclaimer, the term of this patent is extended or adjusted under 35 U.S.C. 154(b) by 196 days.

(21) Appl. No.: 13/325,313

(22) Filed: Dec. 14, 2011

(65) Prior Publication Data

US 2013/0118465 A1 May 16, 2013

Related U.S. Application Data

(60) Provisional application No. 61/560,429, filed on Nov. 16, 2011.

(51) Int. Cl.
*F41B 11/00* (2013.01)

(52) U.S. Cl.
USPC ..... 124/65; 124/64

(58) Field of Classification Search
USPC ..... 124/63–68
See application file for complete search history.

(56) References Cited

U.S. PATENT DOCUMENTS

| | | | | |
|---|---|---|---|---|
| 571,260 | A | 11/1896 | Borchardt | |
| 961,511 | A | 6/1910 | Marble | |
| 1,374,757 | A | 4/1921 | Napier | |
| 2,634,548 | A * | 4/1953 | Langos | 446/182 |
| 2,977,951 | A | 4/1961 | Cavin | |
| 3,233,601 | A | 2/1966 | Walther | |
| 3,236,224 | A | 2/1966 | Pitcher | |
| 3,385,279 | A | 5/1968 | Pitcher | |
| 3,913,554 | A * | 10/1975 | Pitcher | 124/67 |
| 3,968,783 | A | 7/1976 | Pfotenhauer | |
| 4,170,215 | A | 10/1979 | Kettlestrings | |
| 4,248,202 | A | 2/1981 | Jaworski et al. | |
| 4,659,320 | A | 4/1987 | Rich et al. | |
| 4,771,758 | A | 9/1988 | Taylor et al. | |
| 5,471,967 | A | 12/1995 | Matsuzaki et al. | |
| 5,529,050 | A | 6/1996 | D'Andrade | |
| 5,611,322 | A | 3/1997 | Matsuzaki et al. | |
| 5,852,891 | A | 12/1998 | Onishi et al. | |
| 5,996,564 | A | 12/1999 | Kotowski | |
| 6,224,457 | B1 | 5/2001 | Wu | |
| 6,343,598 | B1 | 2/2002 | Pshenychny | |
| 6,598,329 | B1 | 7/2003 | Alexander | |
| 6,733,356 | B2 | 5/2004 | Lee | |
| 6,857,422 | B2 * | 2/2005 | Pedicini et al. | 124/63 |
| 7,032,837 | B2 | 4/2006 | Eddins et al. | |
| 7,267,118 | B2 * | 9/2007 | Eddins et al. | 124/63 |

(Continued)

OTHER PUBLICATIONS

PCT/US2012/064636—International Search Report. dated Feb. 28, 2013.

(Continued)

*Primary Examiner* — Michael David
(74) *Attorney, Agent, or Firm* — Perry Hoffman

(57) ABSTRACT

An air gun toy which has a housing mounting a cylinder and a piston for compressing air to cause foam darts to be discharged. The air gun includes the piston, a first connector pivotally connecting a first link to the piston, a second connector pivotally connecting the first link to a second link, a third connector pivotally connecting the second link to housing, a main spring and a trigger. When the piston reaches its forward position, the first, second and third connectors align in a linear configuration, like a toggle joint, to brace the piston and prevent piston bounce back.

20 Claims, 7 Drawing Sheets

(56) References Cited

U.S. PATENT DOCUMENTS

| | | | | |
|---|---|---|---|---|
| 7,287,526 | B1 | 10/2007 | Bligh et al. | |
| 7,418,797 | B1 | 9/2008 | Crose | |
| 7,437,847 | B1 | 10/2008 | Mabry | |
| 7,552,557 | B1 | 6/2009 | Mabry | |
| 7,673,624 | B2 | 3/2010 | Rosella, Jr. | |
| 7,984,708 | B2 * | 7/2011 | Pedicni et al. | 124/65 |
| 2005/0000505 | A1 * | 1/2005 | Pedicini et al. | 124/63 |
| 2005/0183708 | A1 * | 8/2005 | Eddins et al. | 124/59 |
| 2005/0188974 | A1 * | 9/2005 | Pedicini et al. | 124/65 |
| 2005/0235975 | A1 * | 10/2005 | Pedicini et al. | 124/67 |
| 2006/0242880 | A1 | 11/2006 | Griffin | |
| 2007/0101982 | A1 * | 5/2007 | Ong et al. | 124/65 |
| 2011/0220088 | A1 * | 9/2011 | Maggiore | 124/76 |
| 2011/0232618 | A1 * | 9/2011 | Gabrel | 124/73 |

OTHER PUBLICATIONS

PCT/US2012/064636—Written Opinion of the International Searching Authority. dated Feb. 28, 2013.

PCT/US2012/064636-Notification of Transmittal of the International Search Report and the Written Opinion of the International Searching Authority or the Declaration. Feb. 28, 2013.

* cited by examiner

AIR GUN APPARATUS

CROSS-REFERENCE TO RELATED APPLICATION

This application claims priority pursuant to 35 U.S.C. 119 (e) to U.S. Provisional Application No. 61/560,429, filed on Nov. 16, 2011 which is incorporated herein by reference in its entirety.

FIELD OF THE INVENTION

The present invention relates generally to air gun apparatus, and, more particularly, to toy air gun apparatus having a piston moving in a cylinder for discharging toy projectiles where the problem of piston bounce back is eliminated.

BACKGROUND OF THE INVENTION

Toys and other devices that discharge projectiles using compressed air created by a piston in a cylinder have an inherent problem, namely piston bounce or bounce back as the piston reaches its forward position in the cylinder and the compressed air created by the piston's movement is unable to exit the cylinder quickly enough. Bounce back is inefficient and prevents transfer of all of the energy available to the projectile being discharged. Air guns are well known and are disclosed in several existing patents. By way of example, U.S. Pat. No. 2,977,951 for a "Gun" issued in 1961 to Cavin purports to disclose an air-operated pistol including a piston in a cylinder, a piston rod pivotally connected to a pivotal hammer, and a coil spring located between the piston and the hammer. When the hammer is pivoted rearward, the piston is retracted and the coil spring compresses. The elements are held in place by a vertically slidable plate engaged in a notch in the piston rod. When a trigger is pulled the plate is disengaged from the piston rod and the spring pushes the piston forward to discharge a pellet.

Two patents issued to Pitcher, U.S. Pat. No. 3,236,224, granted in 1966 for an "Air Pistol," and U.S. Pat. No. 3,385,279 granted in 1968 for a "Pneumatic Pistol With Mean For Varying The Compressed Air Pressure." These patents purport to disclose an air pistol having a cylinder, a piston in the cylinder, a piston rod connected to a pivotal hammer and a coil spring connected to the hammer. The weapon is cocked by pulling back on the hammer causing the spring to extend. When a trigger is pulled the hammer is released causing the rod to push the piston forward under the influence of the retracting spring to discharge a missile. U.S. Pat. No. 4,771,758, for an "Air Weapon With Air Compression System Having Grooves For Air Transfer" issued in 1988 to Taylor and Theobald, purports to disclose an air gun with the same elements described above, but with a modification to the front of the piston to address piston bounce, "the tendency for the piston to bounce off trapped air between the piston crown (or front surface) and the front end wall of the cylinder." The front of the piston has grooves directed radially with one groove aligned with a discharge port so as to direct the compressed air to the port during the final compression stage where the piston is almost at the end of its forward travel.

These patents and the devices disclosed are of some interest, however, they do not teach a suitable solution to piston bounce back.

SUMMARY OF THE INVENTION

In accordance with the present invention, an advantageous method and apparatus are provided in the form of two air gun apparatus embodiments that uses a piston in a cylinder to compress air to cause discharge of a projectile. A major problem with earlier air gun apparatus is that when the piston reaches the end of its forward travel, compressed air not able to exit quickly enough causes the piston to bounce back engendering inefficiencies in the apparatus. The present invention eliminates the bounce back problem. The air gun apparatus includes a spring adjustment for lengthening and shortening the spring and thereby increasing or decreasing the energy available for discharging a projectile and the degree of strength needed to pull back a trigger. The air gun apparatus is easily operated, structurally robust, compact and relatively inexpensive.

Briefly summarized, the invention relates to an air gun apparatus having a piston moving in a cylinder to compress air, the air gun apparatus including a housing for mounting the cylinder and piston, the piston for moving between forward and rearward positions in the cylinder, a first link, a first connector pivotally connecting the first link to the piston, a second link, a second connector spaced from the first connector pivotally connecting the second link to the first link, and a third connector spaced from the first and second connectors pivotally connecting the second link to the housing, wherein the first connector, the second connector and the third connector align in a generally linear configuration when the piston reaches the forward position.

The invention also relates to a method for making an air gun apparatus including the steps of forming a housing, mounting a cylinder and a piston in the housing, wherein the piston is movable between a forward position and a rearward position in the cylinder, pivotally connecting a first link to the piston with a first connector, pivotally connecting a second link to the first link with a second connector, the second connector being spaced from the first connector, pivotally connecting the second link to the housing, and aligning the first connector, the second connector and the third connector in a generally linear configuration when the piston reaches the forward position.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
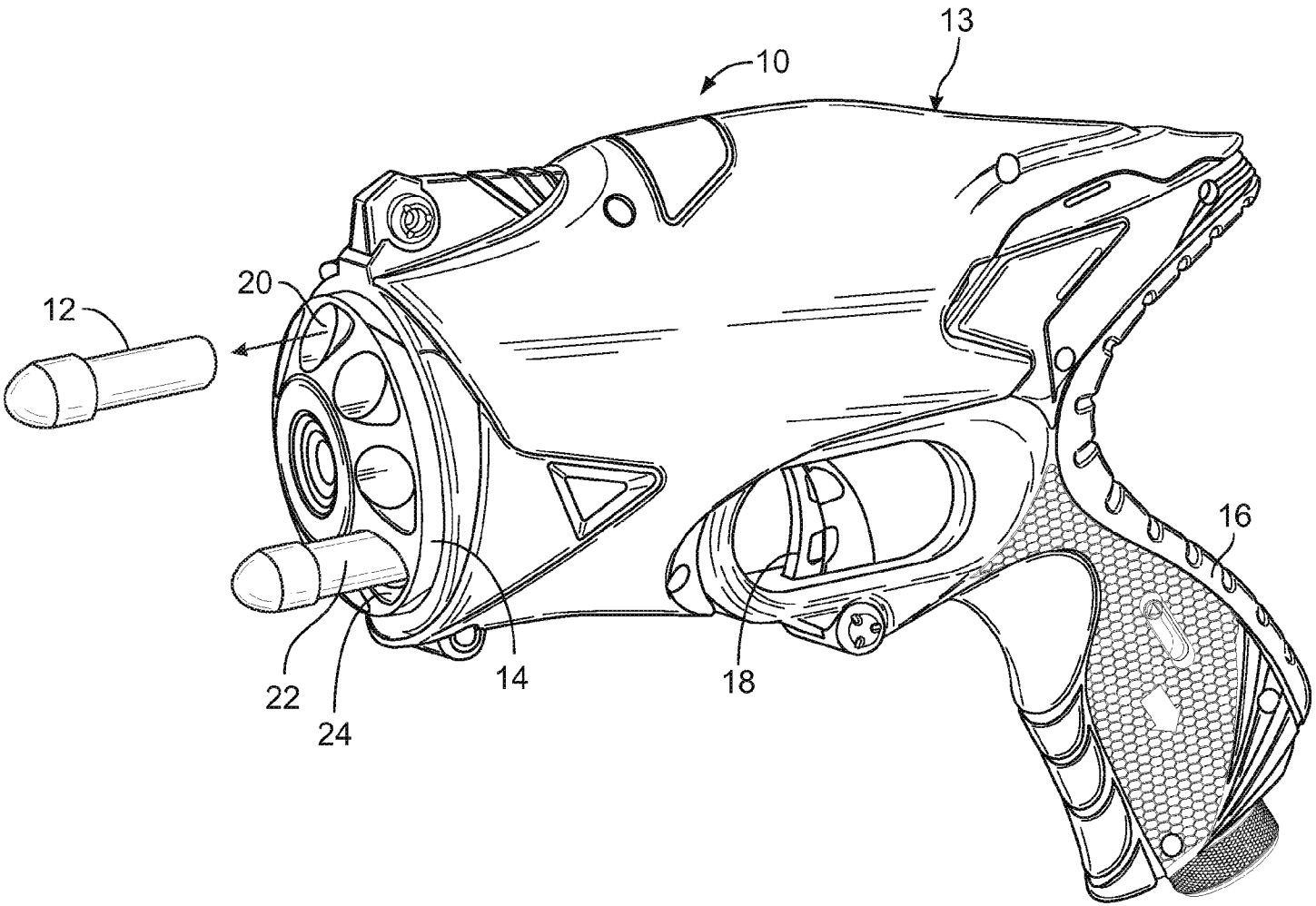
FIG. 1 is a diagrammatic isometric view of a preferred embodiment of the present invention in the form of a toy air gun apparatus discharging a dart.
Figure 5:
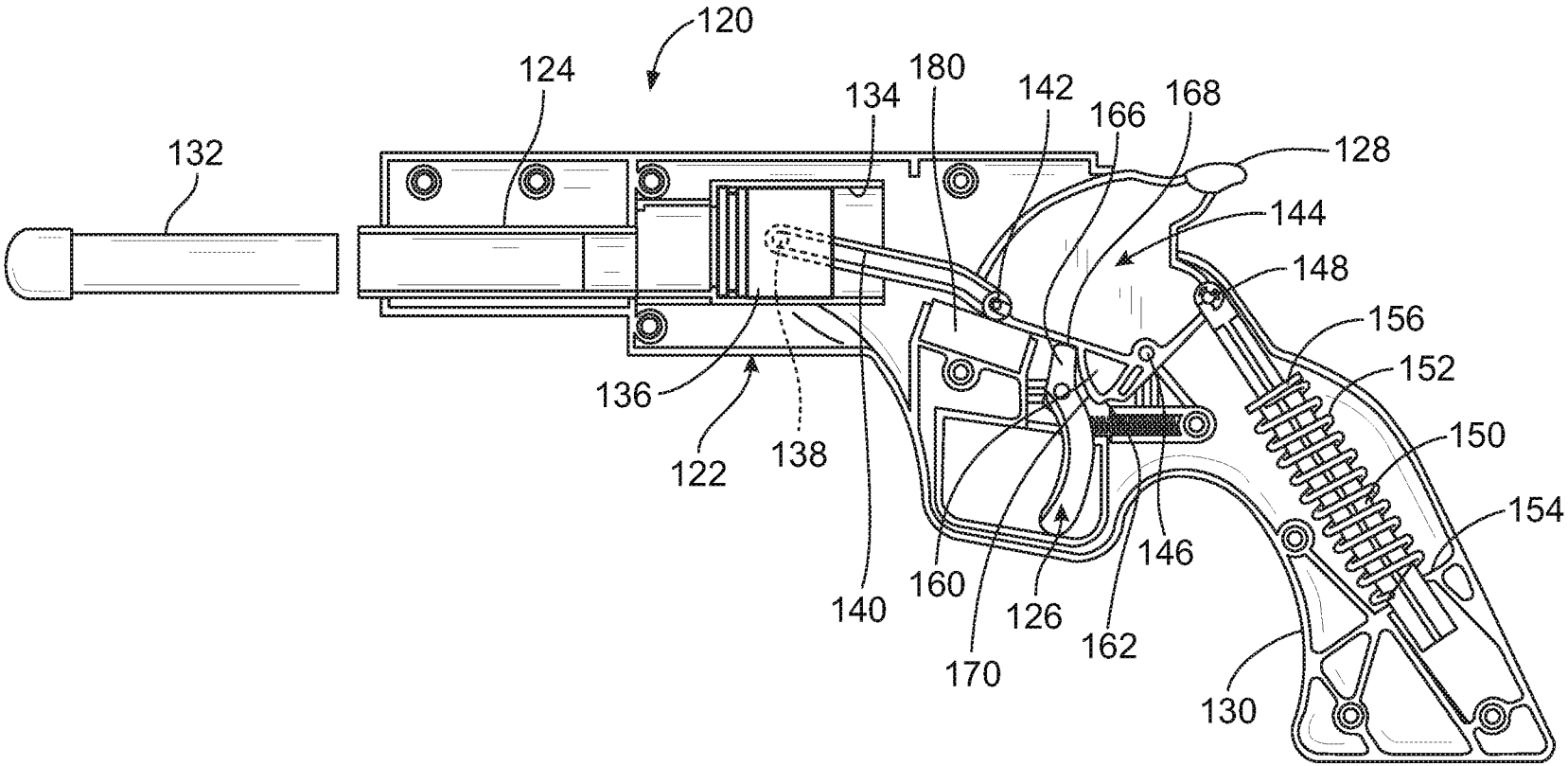
FIG. 5 is diagrammatic side elevation view of another preferred embodiment of an air gun apparatus illustrated in a piston-braced configuration.
Figure 6:
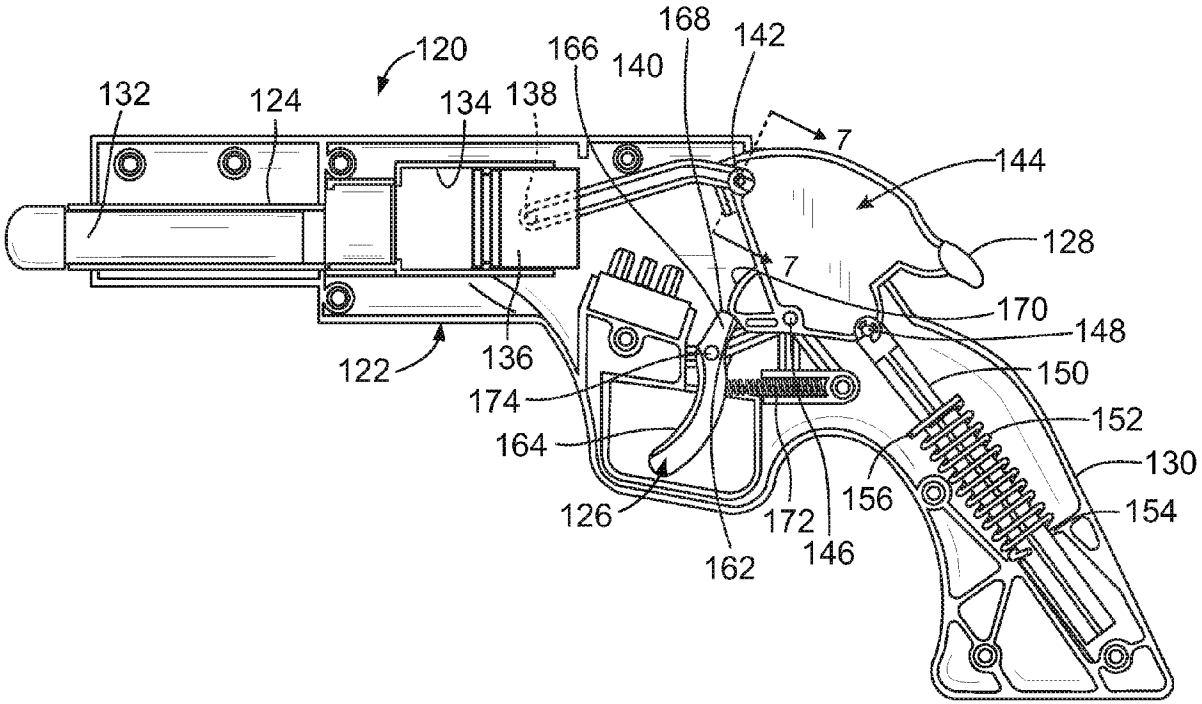
FIG. 6 is a diagrammatic side elevation view of the air gun apparatus illustrated in FIG. 5, in a cocked configuration.

Referring now to FIG. 1, there is shown a preferred embodiment of the invention in the form of a toy air gun apparatus 10 for discharging projectiles, such as a dart 12, using compressed air that is generated by a piston moving rapidly in a cylinder within the air gun apparatus. The dart 12 includes toy foam or soft, spongy, cellular material darts, e.g. NERF™ brand darts. The air gun apparatus 10 includes a housing 13, a rotatable barrel assembly 14 mounted in a forward portion of the housing, a grip 16 formed in a rearward portion of the housing, and a trigger 18. The barrel assembly 14 includes a discharge or ejection opening 20. Another dart 22 in another discharge opening 24 is also illustrated. When the barrel assembly rotates the dart 22 to the upper most position, the position shown occupied by the opening 20, the dart 22 will be in position to be ejected. As will be explained in more detail below, the cylinder includes a forward wall with a port for exiting compressed air, and behind the piston is a linkage connected to the piston and to a main coil spring that provides the energy for causing discharge. The trigger 18 is part of a firing mechanism that stretches or tensions the main spring and retracts the piston to a cocked position. (In an embodiment illustrated in FIGS. 5 and 6, an alternative structure is described where the firing mechanism squeezes or compresses the main spring.) Thereafter, the tensioned main spring is released to enable it to snap back to its starting position causing the piston to rush forward and compress air in the cylinder between the piston and the forward wall of the cylinder. The compressed air exits through the port to propel the dart. The housing may be made of a suitable synthetic resin well known by those skilled in the art and have a fanciful design as shown, simulate a space weapon, or carry a motif from popular entertainment, such as "Star Wars." The embodiments described here include the toy foam or cellular material darts 12, 22. In the alternative, the air gun may look more like a real gun, as shown in FIGS. 5 and 6, and/or may discharge other types of projectiles, such as BBs, balls or pellets. Also in the alternative, the air gun apparatus may be made of metal or a combination of metal and plastic.

Figure 2:
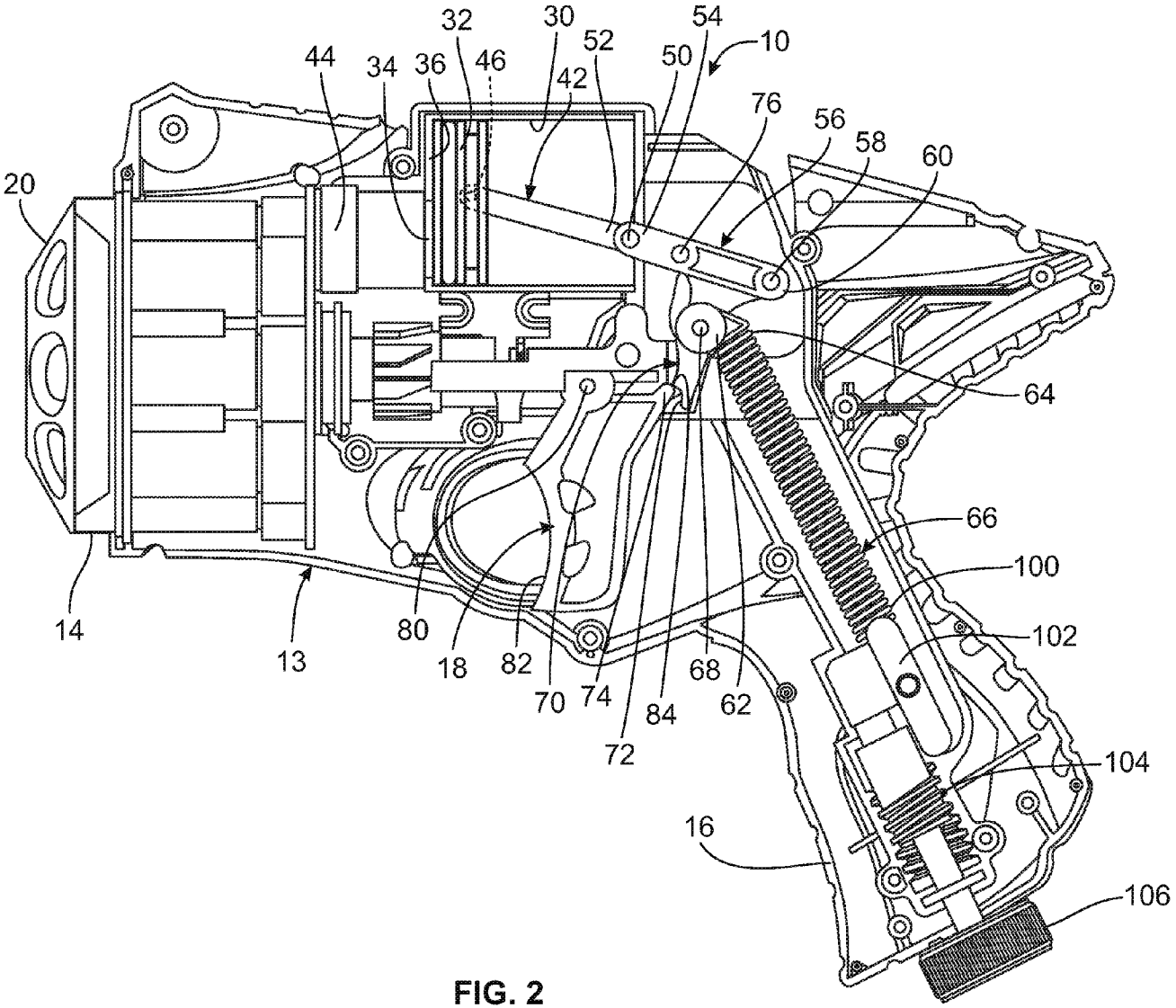
FIG. 2 is a diagrammatic side elevation view of the interior of the toy air gun apparatus shown in FIG. 1, illustrating a cylinder having a piston in a forward position.
Figure 3:
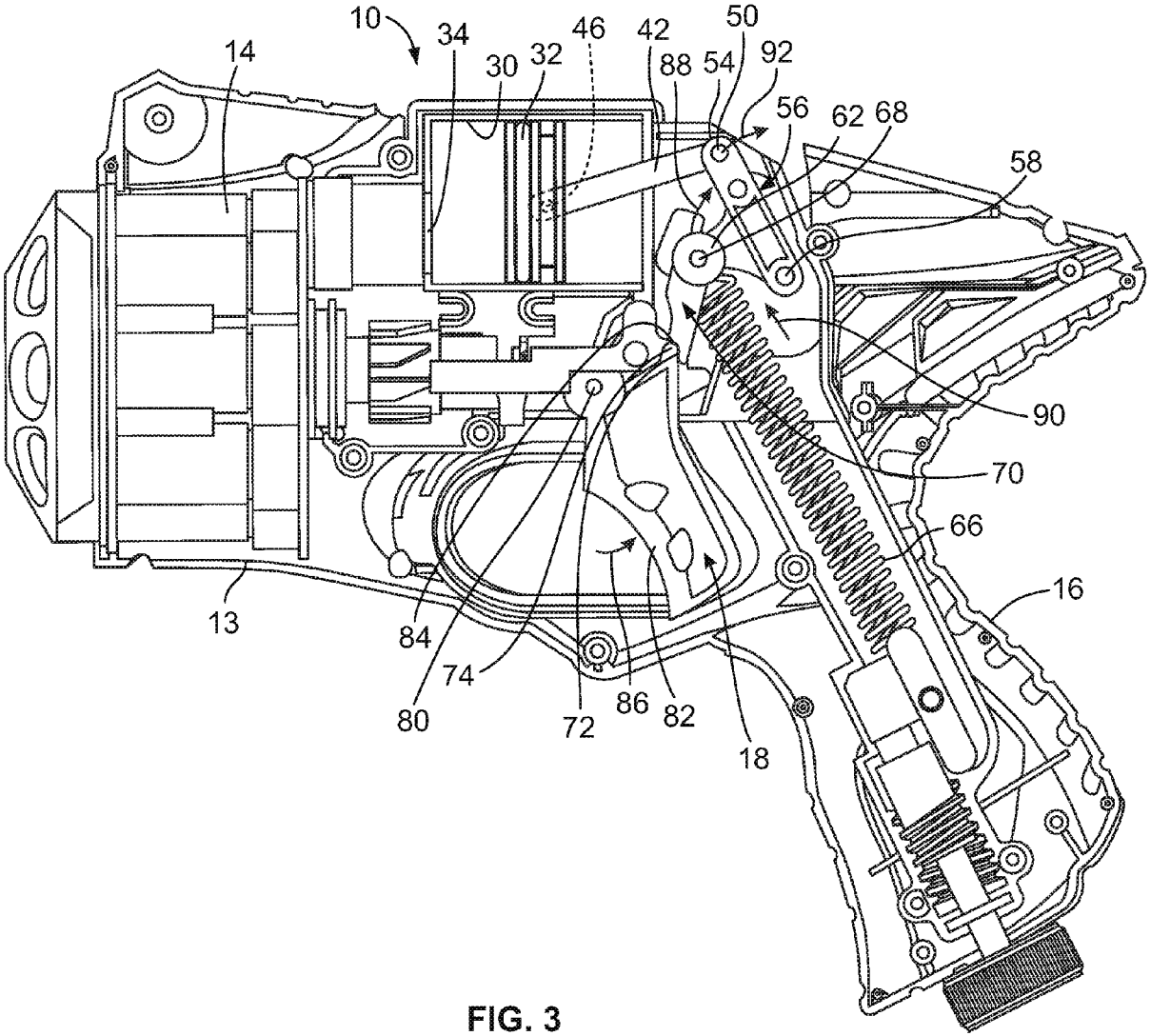
FIG. 3 is a diagrammatic side elevation view of the toy air gun apparatus shown in FIG. 2, illustrating the piston in a cocked, rearward position.
Figure 4:
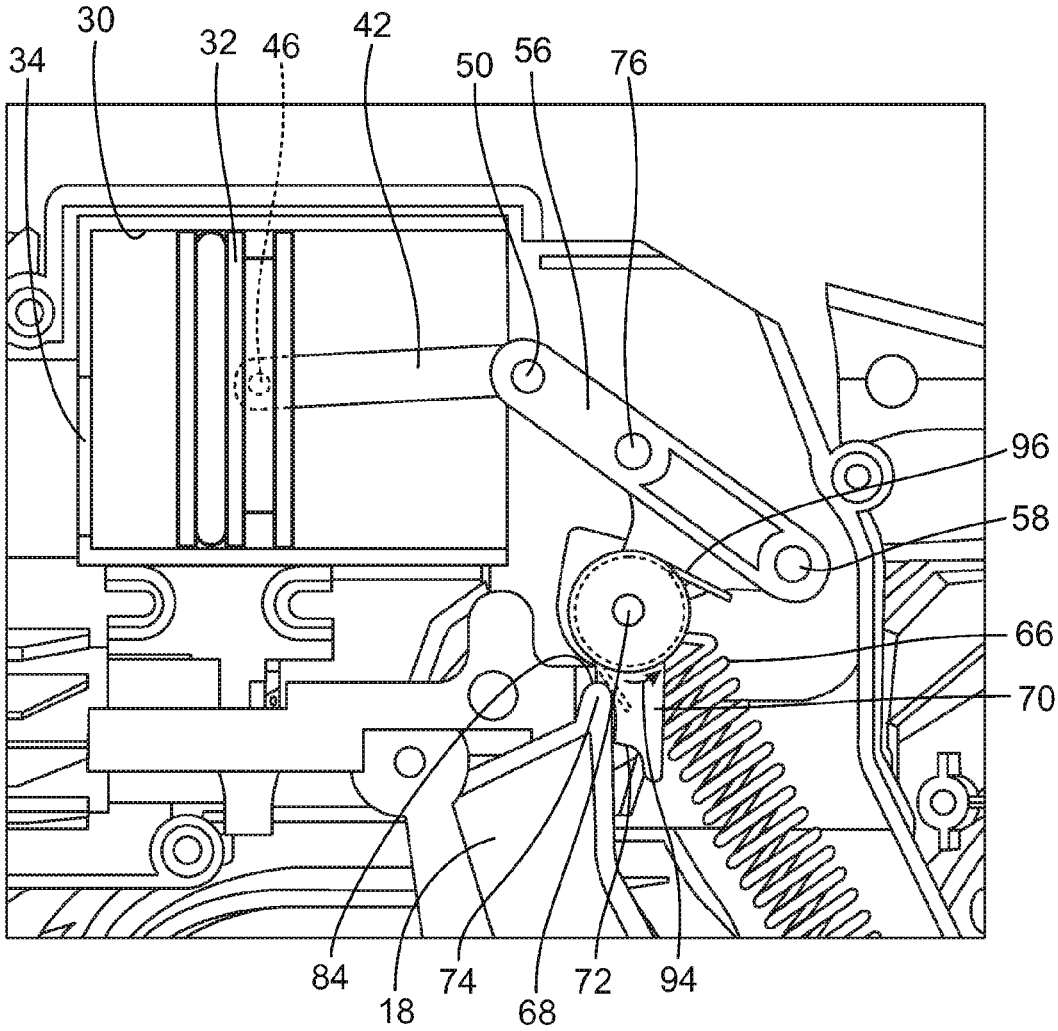
FIG. 4 is an enlarged, diagrammatic, partial side elevation view of the toy air gun apparatus shown in FIG. 3, illustrating the piston beginning its forward movement from its rearward position.

Referring now to FIGS. 2-4, the interior of the air gun apparatus 10 is illustrated in detail. The cylinder 30 is located just rearward of the barrel assembly 14, in which the piston 32 is movable between a forward position shown in FIG. 2, and a rearward position shown in FIG. 3. The port 34 is formed in the cylinder forward wall 36 through which air compressed by the piston will pass. In front of the forward wall 36 and rearward of the discharge opening 20 is a safety valve chamber 44. A piston rod or first link 42 is connected to the piston and extends rearward. A first connector 46 pivotally connects a forward end 48 of the first link 42 to the piston 32. A second connector 50, located spaced from the first connector 46, pivotally connects a rearward end 52 of the first link 42 to a first corner 54 of a second, somewhat triangular shaped, link 56. A third connector 58 pivotally connects a second corner 60 of the second link 56 spaced from the first corner 54, to the housing 13. The third connector 58 is spaced from both the first and the second connectors 46, 50. A third corner 62 of the second link 56 is pivotally connected to an upper end 64 of the main spring 66 by a fourth connector 68. A depending arm 70 is also connected to the fourth connector 68. The depending arm 70 has a lower curved end 72 for engaging an upward extending arm 74 formed as part of the trigger 18. The second link 56 also includes elastomeric shock absorbers to each side, such as the shock absorber 76, for contacting abutment surfaces or flanges (not shown) molded on opposite interior surfaces of the housing 13.

The trigger 18 is part of a firing mechanism that also includes the depending arm 70 and the upward extending arm 74. The trigger is pivotally connected to the housing 13 by a fifth connector 80, and the trigger includes a curved pull surface 82 for an operator to squeeze when operating the air gun apparatus. The upstanding arm 74 includes a smooth rounded end 84 for engaging the curved lower end 72 of the depending arm 70. When the trigger pull surface 82 is pivoted rearward by the operator of the air gun apparatus, as indicated by an arrow 86, FIG. 3, the upward extending arm 74 engages, by abutting, the lower end 72 of the depending arm 70 and causing the third corner 62 of the second link 56 to rotate clockwise about the third connector 58, as indicated by an arrow 88. The rotating third corner 62 of the second link 56 biases the main spring 66 by stretching it upward as indicated by an arrow 90. Rotation of the second link 56 enables the first corner 54 of the second link to also rotate clockwise, as indicated by an arrow 92, pulling the first link 42 rearward. Rearward movement of the first link retracts or moves the piston 32 to its rearward position in the cylinder 30 to cock the air gun apparatus as illustrated in FIG. 3. Because of the geometries and movements of the rounded end 84 of the upward extending arm 74 and the curved lower end 72 of the depending arm 70, as pivoting of the trigger 18 continues, the upward extending arm 74 disengages from the lower end 72 of the depending arm 70 by sliding past the lower end 72 of the depending arm 70, as the depending arm rotates slightly as indicated by an arrow 94, FIG. 4, to release the upward force on the main spring 66 from the upward extending arm on the second link. Without engagement of the upward force on the second link 56, the strong downward biasing force of the main spring 66 quickly rotates the second link 56 counterclockwise. The rapid counterclockwise rotation of the second link snaps the first link 42 and the piston, forward, toward its forward position shown in FIG. 2.

In the alternative, the upper end of the upward extending arm and the lower end of the depending arm may be shaped differently, such as with oblique surfaces, as long as engagement and disengagement occur within the limits of trigger movement.

Moving the piston quickly forward compresses the air between the piston and the front wall of the cylinder. The highly compressed air exits the port and propels the dart. At the end of the forward stroke of the piston 32 when the piston is in its forward position, the first connector 46, the second connector 50 and the third connector 58 align generally in a straight line or linear configuration, as shown in FIG. 2. The first link and the second link line up to form a toggle joint with a pivot at the second connector 50, sometimes called the central pivot point. When the central pivot connector 50 reaches this dead center position, the toggle joint imposes a locking action on the first and second links, applying a forward force on the piston and a rearward force on the housing. The effect is to brace the piston with the housing and prevent rearward movement of the piston, often referred to as "piston bounce back." The prevention of piston bounce back is a major feature of the present invention and increases the air gun's efficiency.

It is noted that the central pivot connector 50 will not rotate past a linear alignment of the first and second links because the shock absorber 76 prevents further downward movement of the connector 50 by contact with the housing abutment surface, and continuing tension in the main spring 66 prevents upward movement of the connector 50. Thus, the toggle joint is locked in the braced position until a user again actuates the trigger.

Attached to the trigger 18 is a trigger return spring (not shown) for rotating the trigger back to its starting position, shown in FIG. 2, once the operator releases the trigger. Realignment of the trigger and the depending arm are accomplished by the trigger and depending arm returning to their starting position, the trigger is returned by the return spring and the depending arm is returned by the slight torque force exerted by a torsion spring 96, FIG. 4, suitably positioned around the third connector 68. A lower end 100, FIG. 2, of the main spring 66 is connected to an arm 102 that in turn is connected to a threaded rotatable shaft 104 and an adjustment knob 106 extending beyond the grip portion 16 of the housing 13. Rotation of the knob 106 in one direction extends the main spring 66 to increase tension and thereby the spring's energy, and rotation of the knob in the opposite direction shortens the main spring 66 and reduces the energy of the spring. The main spring is always in tension, from the most stretched position shown in FIG. 3, when the air gun is cocked, to a less stretched position when the air gun apparatus is at rest and the central pivot (the second connector 50) is biased downward to maintain the brace on the piston. Adjustment of the main spring tension is another feature of the invention.

The barrel assembly includes multiple discharge openings, such as the discharge openings 20, 24. After ejection of a dart, the barrel assembly rotates and, if a discharge opening with a dart is moved to the position forward of the piston, the air gun apparatus may be "fired" again. In the alternative, the barrel assembly may be fixed, or a single shot design may be used. Discharge of darts occurs only at the dart opening adjacent the cylinder and piston. It is noted that throughout this disclosure, words such as "forward", "rearward", "upward", "downward", "upper", and "lower", "clockwise" and "counterclockwise", as well as like terms, refer to portions or elements of the air gun apparatus as they are viewed in the drawings relative to other portions or in relationship to the positions of the apparatus as it will typically be held and moved during play when operated by a user, or to movements of elements based on the configurations illustrated.

In operation, when an operator pulls back on the pull surface 82 of the trigger 18 causing the trigger to pivot about the fifth connector 80, the rounded end 84 of the arm 74 engages the curved lower end 72 of the arm 70 causing the second link to rotate clockwise about the third connector 58 which stretches the main spring 66 and pulls the second connector 50 and the first link 42 rearward. The rearward movement of the first link pulls the first connector 46 and the piston 32 rearward. When, because of geometries and movements, the end 84 of the arm 74 and the end 72 of the arm 70 disengage, the main spring retracts quickly, causing the second link to rapidly rotate counterclockwise. Rapid counterclockwise rotation causes the first link to snap the piston forward. When the piston reaches its forward position, as shown in FIG. 2, the first and second links and the second connector 50 act like a toggle joint, as mentioned, so that the first, second and third connectors 46, 50, 58 align generally in a straight line to brace the piston with the housing 13. The shock absorber 76 and the main spring 66, lock the first and second links in the piston bracing position.

The toy air gun apparatus may include, in the alternative, a projectile magazine, a cartridge, a cassette or a canister loaded with multiple projectiles to load projectiles into a firing or discharge position. The barrel assembly may be rotatable as shown, or, as mentioned, may be fixed.

Referring now to FIGS. 5 and 6, another preferred embodiment of the present invention is illustrated in the form of a single shot air gun apparatus 120 having a shape simulating an Old West six-shooter. Similar to the air gun apparatus 10, the air gun apparatus 120 includes a housing 122 with a barrel portion 124, a trigger 126, a tab 128 (the tab simulating a hammer spur of a six-shooter) and a grip portion 130. In front of the barrel portion 124 at the forward end of the air gun apparatus is a discharging dart 132, FIG. 5, in front of a cylinder 134 having a reciprocating piston 136 moveable between forward and rearward positions. The forward position of the piston is illustrated in FIG. 5, and the rearward position is illustrated in FIG. 6. A first connector 138 pivotally connects the piston 136 to a first link 140, and a second connector 142 pivotally connects the first link 140 to a second link 144, the second connector 142 being spaced from the first connector 138. A third connector 146, spaced from both the first and second connectors 138, 142, pivotally connects the second link 144 to the housing 122. A fourth connector 148 pivotally connects the second link 144 to a post 150 around which is a main spring 152. A flange 154 molded with the housing in the grip portion 130 acts as a lower spring seat for the main spring 152 and a post flange 156 acts as an upper spring seat allowing the main spring to be compressed between the two seats 154, 156 when the second link 144 is rotated clockwise, as illustrated in FIG. 6.

Integral at an upper portion of the second link 144 is the tab 128 located generally above the trigger 126 and the grip portion 130 of the housing 122 and within easy reach of an operator's thumb when the air gun apparatus is held with the fingers and palm around the grip portion and a forefinger against the trigger. At a lower portion of the second link 144 is an arm 160 with a trigger abutment surface 162. The trigger 126 includes a curved pull surface 164, and an arm 166 with an upper, second link abutment surface 168. Unlike the air gun apparatus 10 which operates by having the trigger both cock and discharge the apparatus, when the operator pulls the tab 128 downward with his/her thumb, the second link 144 is rotated clockwise about the third connector 146 from an at rest, braced position shown in FIG. 5, to a cocked position shown in FIG. 6, causing the main spring 152 to be biased by compression when the upper spring seat 156 is pushed downward toward the stationary lower spring seat 154. At the same time, a curved surface 170 on the second link 144 slides passed the trigger 126 until the abutment surface 162 of the second link 144 engages the abutment surface 168 of the trigger arm 166 allowing a trigger return spring 172 to bias the trigger 126 forward rotating around a fifth connector 174 pivotally connecting the trigger 126 to the housing 122 and enabling the second link 144 and the trigger to assume a locked condition.

The air gun apparatus is shown fully cocked in FIG. 6, where the abutment surfaces 162, 168 of the arms 160, 166 are engaged. When the operator pulls on the trigger pull surface 164 against the bias of the trigger return spring 172, the abutment surfaces 162, 168 slide apart from one another to release the lock on the second link 144 allowing the main spring 152 to rotate the second link quickly in a counterclockwise direction causing the piston to snap to its forward position.

Figure 7:
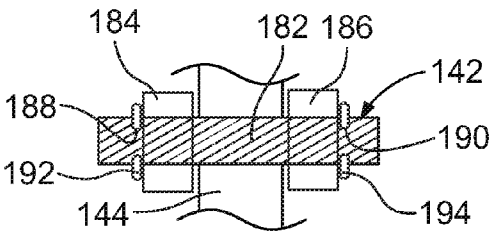
FIG. 7 is an enlarged section view of a connector taken along line 7-7 in FIG. 6.

The air gun apparatus may also include cushion material, such as the block 180, to absorb the shock of the rapidly rotating second link after the trigger is pulled. The second connector 142, FIG. 7, includes a shaft 182 extended through a forked end 184, 186 of the first link 140 with the second link 144 sandwiched there between. The shaft has grooves 188, 190 formed near the shaft's end portions to receive retaining rings 192, 194 for holding the connector in place. All of the other connectors may be similarly configured, or in the alternative, other connector structures may be used, such as rivets, bolts, pegs or the like. Also in the alternative, the barrel portion may be rotational similar to that shown for the air gun apparatus 10 with multiple openings for multiple darts.

In operation, the air gun apparatus 120, at rest or just after discharge, has the configuration shown in FIG. 5, where the first, second, and third connectors 138, 142, 146 are generally aligned in a straight line to brace the piston 136 against the housing 122 and prevent piston bounce back. Note that the first link is not required to be linear when space considerations may necessitate another shape. When the operator desires to discharge the air gun apparatus, a dart, such as the dart 132, is loaded into the barrel portion 124, FIG. 6, and the tab 128 of the second link 144 is rotated downward to the position shown in FIG. 6. Rotating the second link downward, or clockwise, causes the first link 140 and the piston 136 to be pulled rearward and the abutment surfaces of the trigger and the second link to engage and maintain the air gun apparatus in the cocked condition. To cause discharge the operator pulls rearward on the trigger to slide the abutment surfaces apart allowing the compressed main spring to rapidly rotate the second link counterclockwise about the connector 146 causing the first link and the piston to snap forward in the cylinder compressing air forward of the quickly moving piston as the piston moves from its rearward position to its forward position.

Figure 8:
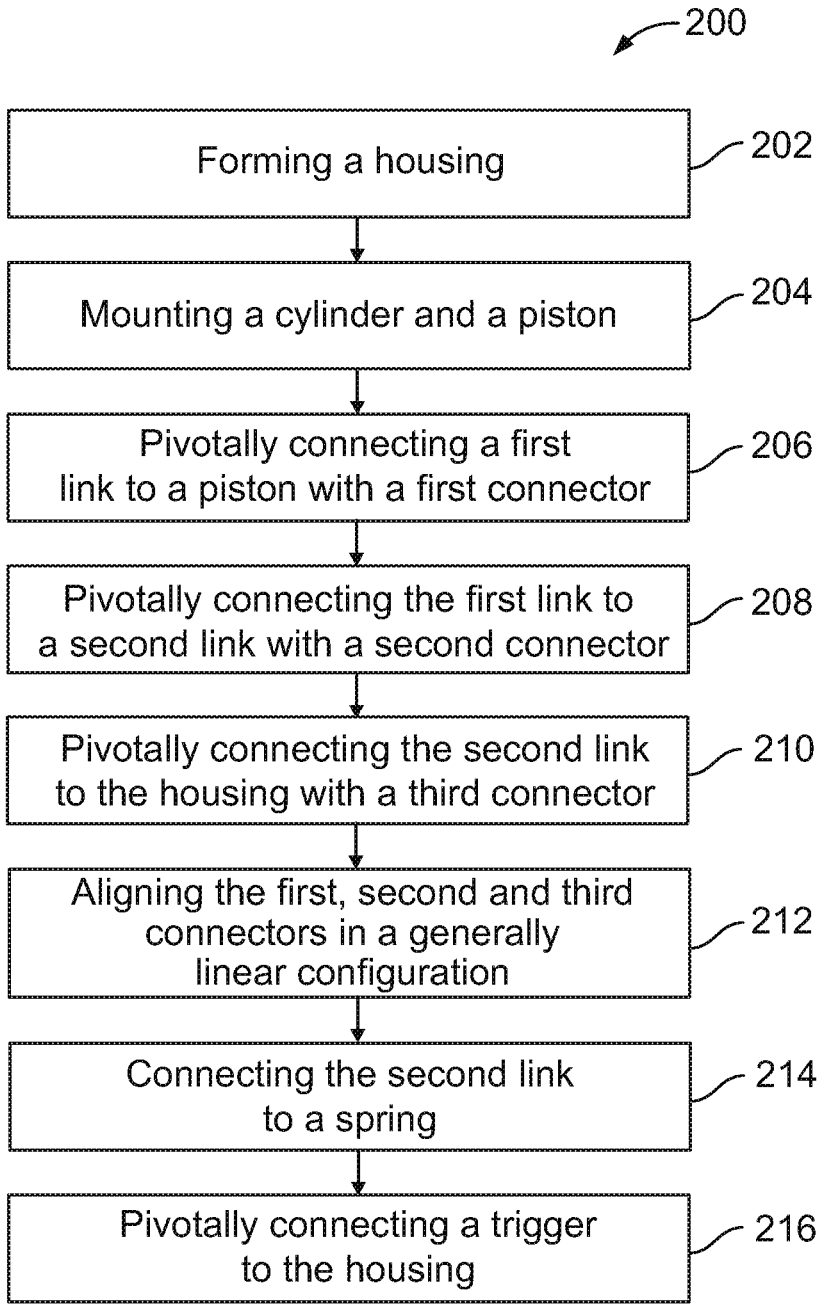
FIG. 8 is a flow diagram for a method of making an air gun apparatus.

The present invention also includes a method 200, FIG. 8, for making an air gun apparatus and includes the steps of forming a housing 202 and mounting a cylinder and a piston in the housing 204, where the piston is movable between a forward position and a rearward position in the cylinder. Pivotally connecting a first link to the piston with a first connector 206 and pivotally connecting a second link to the first link with a second connector 208, the second connector being spaced from the first connector. Pivotally connecting the second link to the housing 210 with a third connector and aligning the first connector, the second connector and the third connector in a generally linear configuration when the piston is in the forward position 212. The method may also include connecting a spring to the second link 214, and pivotally mounting a trigger to the housing for operating the spring 216. The air gun apparatus may be made such that moving the trigger rearward pivots the second link and tensions the spring, moves the piston rearward and then releases tension in the spring, or by mounting the second link to compress the spring when the second link is directly rotated rearward or downward by an operator's thumb and mounting the trigger such that a rearward pivot of the trigger releases the spring. The air gun apparatus may also include mounting the spring to an adjustment shaft such that rotation of the shaft one way increases the biasing force of the spring, and rotating the shaft in an opposite direction decreases the biasing force of the spring.

The air gun apparatus disclosed in detail above eliminates piston bounce back, allows for spring adjustment, is fun to use and easy to operate in a safe manner, and yet the air gun apparatus has a robust, but relatively simple structure, that may be produced at a reasonable cost.

From the foregoing, it can be seen that there has been provided features for improved toy air gun apparatus and a disclosure for the method of the making the air gun apparatus. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. An air gun apparatus having a piston moving in a cylinder to compress air, the air gun apparatus comprising:

a housing for mounting the cylinder and piston, the piston for moving between forward and rearward positions in the cylinder;

a first link;

a first connector pivotally connecting the first link to the piston;

a second link;

a second connector spaced from the first connector pivotally connecting the second link to the first link; and a third connector spaced from the first and second connectors pivotally connecting the second link to the housing, wherein the first connector, the second connector and the third connector align in a generally linear configuration when the piston reaches the forward position.

2. The air gun apparatus of claim 1, including:

a spring having one end connected to the second link; and a trigger pivotally connected to the housing for operating the spring.

3. The air gun apparatus of claim 2, including:

a first arm connected to the second link; and a second arm connected to the trigger, wherein movement and geometry of the first and second arms enable the spring to be released from a biased position.

4. The air gun apparatus of claim 3, wherein:

the first and second arms slide relative to one another to enable the spring to be released.

5. The air gun apparatus of claim 2, wherein:

the spring is connected to the second link at a location spaced from the second and third connectors.

6. The air gun apparatus of claim 2, wherein:

rotational movement of the second link biases the spring and causes the piston to move to the rearward position.

7. The air gun apparatus of claim 1, including:

a spring connected to the second link; and a release mechanism coupled with the second link, wherein the second link and the release mechanism cooperate to tension and release the spring.

8. The air gun apparatus of claim 1, including:

a spring connected to the second link; and a release mechanism coupled with the second link, wherein the second link and the release mechanism cooperated to compress and release the spring.

9. The air gun apparatus of claim 1, including:

a spring having a first end connected to the second link; and an adjustment shaft connected to a second end of the spring.

10. An air gun apparatus comprising:

a housing for mounting a cylinder and a piston, the piston for moving between forward and rearward positions in the cylinder;

a first link;

a first connector pivotally connecting the first link to the piston;

a second link;

a second connector spaced from the first connector pivotally connecting the second link to the first link;

a third connector spaced from the first and second connectors pivotally connecting the second link to the housing;

a spring having one end connected to the second link at a location spaced from the second and third connectors; and a trigger pivotally connected to the housing for operating the spring, wherein the first connector, the second connector and the third connector align in a generally linear configuration when the piston reaches the forward position from the rearward position.

11. The air gun apparatus of claim 10, wherein:

a first arm is connected to the second link; and a second arm is connected to the trigger, wherein movement and geometry of the first and second arms enable the spring to be released from a biased configuration.

12. The air gun apparatus of claim 11, wherein:

the first and second arms slide relative to one another to enable the spring to be released.

13. The air gun apparatus of claim 12, wherein:

rotational movement of the second link biases the spring and causes the piston to move to the rearward position.

14. The air gun apparatus of claim 13, including:

a release mechanism coupled with the second link, wherein the second link and the release mechanism cooperate to tension and release the spring.

15. The air gun apparatus of claim 13, including:

a release mechanism coupled with the second link, wherein the second link and the release mechanism cooperated to compress and release the spring.

16. A method for making an air gun apparatus comprising the steps of:

forming a housing;

mounting a cylinder and a piston in the housing, wherein the piston is movable between a forward position and a rearward position in the cylinder;

pivotally connecting a first link to the piston with a first connector;

pivotally connecting a second link to the first link with a second connector, the second connector being spaced from the first connector;

pivotally connecting the second link to the housing with a third connector; and aligning the first connector, the second connector and the third connector in a generally linear configuration when the piston is in the forward position.

17. The method of claim 16 including the steps of:

connecting a spring to the second link; and pivotally mounting a trigger to the housing for operating the spring.

18. The method of claim 17 including the step of:

mounting the trigger such that a rearward pivot of the trigger moves the second link and tensions the spring, moves the piston rearward and releases the spring.

19. The method of claim 17 including the steps of:

mounting the second link to compress the spring when the second link is rotated rearward; and mounting the trigger such that a rearward pivot of the trigger releases the spring.

20. The method of claim 17 including the step of:

mounting the spring to an adjustment shaft.

* * * * *